US006205310B1

(12) United States Patent
Onishi

(10) Patent No.: US 6,205,310 B1
(45) Date of Patent: Mar. 20, 2001

(54) ELECTROPHOTOGRAPHIC RECORDING APPARATUS HAVING A CHARGING ROLLER WITH A SURFACE LAYER COMPRISING A RESIN AND A HARDENER

(75) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/240,956

(22) Filed: Jan. 29, 1999

(30) Foreign Application Priority Data

Feb. 2, 1998 (JP) ..... 10-021034

(51) Int. Cl.[7] ..... G03G 15/02
(52) U.S. Cl. ..... 399/176
(58) Field of Search ..... 399/174, 176; 492/56, 59

(56) References Cited

U.S. PATENT DOCUMENTS 5,592,263 * 1/1997 Adachi et al. ..... 399/176
5,608,500 * 3/1997 Funabashi et al. ..... 399/176
5,751,801 * 5/1998 Murata et al. ..... 399/176
5,761,581 * 6/1998 Nojima ..... 399/176 X
6,020,054 * 2/2000 Masuda et al. ..... 399/176 X

* cited by examiner

*Primary Examiner*—Fred L Braun
(74) *Attorney, Agent, or Firm*—Akin, Gump, Strauss, Hauer & Feld, L.L.P.

(57) ABSTRACT

An electrophotographic recording apparatus having a charging roller with a surface layer having a mixture of a resin and a hardener. The surface layer includes at least 10%, but less than 30%, by weight of the surface layer, of the hardener. This specific surface layer composition prevents the photosensitive drum, which is in contact with the charging roller, from becoming excessively charged. Furthermore, the amount of toner that adheres to the charging roller is reduced by circumferentially rotating the charging roller at a rate faster than the photosensitive drum.

12 Claims, 6 Drawing Sheets

ELECTROPHOTOGRAPHIC RECORDING APPARATUS HAVING A CHARGING ROLLER WITH A SURFACE LAYER COMPRISING A RESIN AND A HARDENER

BACKGROUND OF THE INVENTION

The present invention relates to an electrophotographic recording apparatus including a charging roller for charging the photosensitive drum to a desired potential, and more particularly to an electrophotographic recording apparatus in which the circumferential speed of the charging roller to the circumferential speed of the photosensitive drum is greater than 1.

The conventional electrophotographic recording apparatus, such as a, printer or a duplicator, generally includes a photosensitive drum having a rotation shaft, and a charging roller having a rotation shaft substantially parallel with the rotation shaft of the photosensitive drum and also holding its own external circumferential surface in contact with the external circumferential surface of the photosensitive drum to thereby give a static charge to the external circumferential surface of the photosensitive drum.

The above-mentioned electrophotographic recording apparatus further includes a developing section for supplying a toner to the statically charged external circumferential surface of the photosensitive drum, and a cleaning section for removing the toner remaining on the photosensitive drum which toner was not transferred to a recording paper. Among the techniques for cleaning the photosensitive drum by the cleaning section, there is a recycle system in which the toner recovered from the photosensitive drum by the cleaning section is returned to the photosensitive drum by the cleaning section, and the toner is carried by the rotating photosensitive drum and collected in the developing section.

In the recycle-system electrophotographic recording apparatus, the greater part of the normally charged toner is removed by the cleaning section oppositely charged with respect to the polarity of the charge on the toner. A small amount of the toner which is opposite in polarity to the greater part of the toner remains on the photosensitive drum and passes through the cleaning section.

In the recycle-system electrophotographic recording apparatus, when the small amount of the toner that has passed through the cleaning section enters between the charging roller and the photosensitive drum, the small amount of the toner adheres to the external circumferential surface of the charging roller, thus producing a so-called filming phenomenon. When the filming phenomenon occurs, the resistance value of the charging roller increases due to the toner adhesion, making it difficult for the charging roller to give a sufficient amount of charge to the photosensitive drum to enable stable printing. To prevent the photosensitive drum from being insufficiently charged, the charging roller is rotated faster than the photosensitive drum to thereby reduce chances that the small amount of the toner enters between the charging roller and the photosensitive drum.

In the recycle-system electrophotographic recording apparatus, however, because the charging roller is rotated faster than the photosensitive drum, by triboelectricity produced between the charging roller and the photosensitive drum, the photosensitive drum is charged to a potential so high as to lead to unstable printing during operation for a long period of time. This results in poor quality printing, which has been a problem.

SUMMARY OF THE INVENTION

Therefore, the object of the present invention is to provide an electrophotographic recording apparatus that can suppress changes in the electrical potential of the photosensitive drum to thereby improve printing quality.

To solve the above problem, the present invention has an essential feature as follows.

According to the present invention, an electrophotographic recording apparatus comprises:

a photosensitive drum having a rotation shaft; and a charging roller for charging the photosensitive drum to a desired potential, the charging roller having a rotation shaft substantially parallel with the rotation shaft of the photosensitive drum and holding an external circumferential surface thereof in contact with the photosensitive drum, the ratio of the circumferential speed of the charging roller to the circumferential speed of the photosensitive drum being greater than 1, wherein the external circumferential surface of the charging roller is defined by a surface layer including a resin and a hardener, and wherein the hardener is included in the surface layer at a proportion of not less than 10 percent and not greater than 30 percent by weight, of the surface layer.

In the electrophotographic recording apparatus according to the present invention, because the surface layer of the charging roller contains 10 percent or more by weight of the above-mentioned hardener, the frictional force produced between the surface layer of the charging roller and the photosensitive drum is reduced sharply, and triboelectricity induced between the charging roller and the photosensitive drum is inhibited.

Because the hardener included in the surface layer of the charging roller is 30 percent or less by weight, this limited content of the hardener inhibits an increase in the amount of the toner adhering to the surface la, which would attend on an increasing surface roughness of the surface layer due to a large amount of the hardener used. Accordingly, an increase in the resistance value of the charging roller due to toner adhesion can be inhibited, thus reducing the insufficiency of the static charge on the photosensitive drum, which would be caused by an increase in the resistance value of the charging roller to inhibit.

In short, in the electrophotographic recording apparatus according to the present invention, it is possible to restrain an excessive static charge on the photosensitive drum by triboelectricity generated between the charging roller and the photosensitive drum. On the other hand, it is also possible to inhibit the insufficiency of the static charge on the photosensitive drum due to an increase in the resistance value of the charging roller attending on this adhesion of the toner to the surface layer. Consequently, the potential of the photosensitive drum is held in a desired adequate range, in other words, the photosensitive drum can be held at a stable potential.

To effectively inhibit the adhesion of the toner to the surface layer, the surface roughness of the surface layer is preferably more than 0 $\mu$m and not greater than 15 $\mu$m. Under this condition, the resistance value of the charging roller can be inhibited from increasing as the result of printing for a long period of time, thus reducing the insufficiency of charge on the photosensitive drum.

The charging roller may be fitted with a generally cylindrical member disposed coaxially with the rotation shaft of the charging roller with its outer surface connected with the surface layer and its inner surface connected with the rotation shaft.

With a charging roller having a higher weight percentage of the hardener included in its surface layer, the fusion bonding force between the surface layer and the photosensitive drum is lower, and there are less chances of the surface layer peeling away from the cylindrical member.

If the surface layer peels off the cylindrical member, a large amount of the toner adheres to the outer surface of the cylindrical member devoid of the surface layer, so that the resistance value of the charging roller increases so much.

According to the present invention, because the surface layer is less liable to separate from the cylindrical member, chances are more effectively reduced that the photosensitive drum is charged insufficiently due to an increase in the resistance value of the charging roller.

To further stabilize the potential of the photosensitive drum, the ratio of the circumferential speed of the charging roller to the circumferential speed of the photosensitive drum is preferably 1.4 or less.

The charging roller is arranged slidably in the direction of the rotation shaft and on a flat plate. The inclination angle at which the charging roller starts to slide when the flat plate is gradually inclined to the horizontal plane is in a specified range. The inclination angle when a sheet for OverHead Project panel is placed on the flat plate and the charging roller starts to slide on the sheet is preferably greater than 0° and less than or equal to 20°.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

The present invention will be described by referring to a printer as an example of the electrophotographic recording apparatus.

Figure 1:
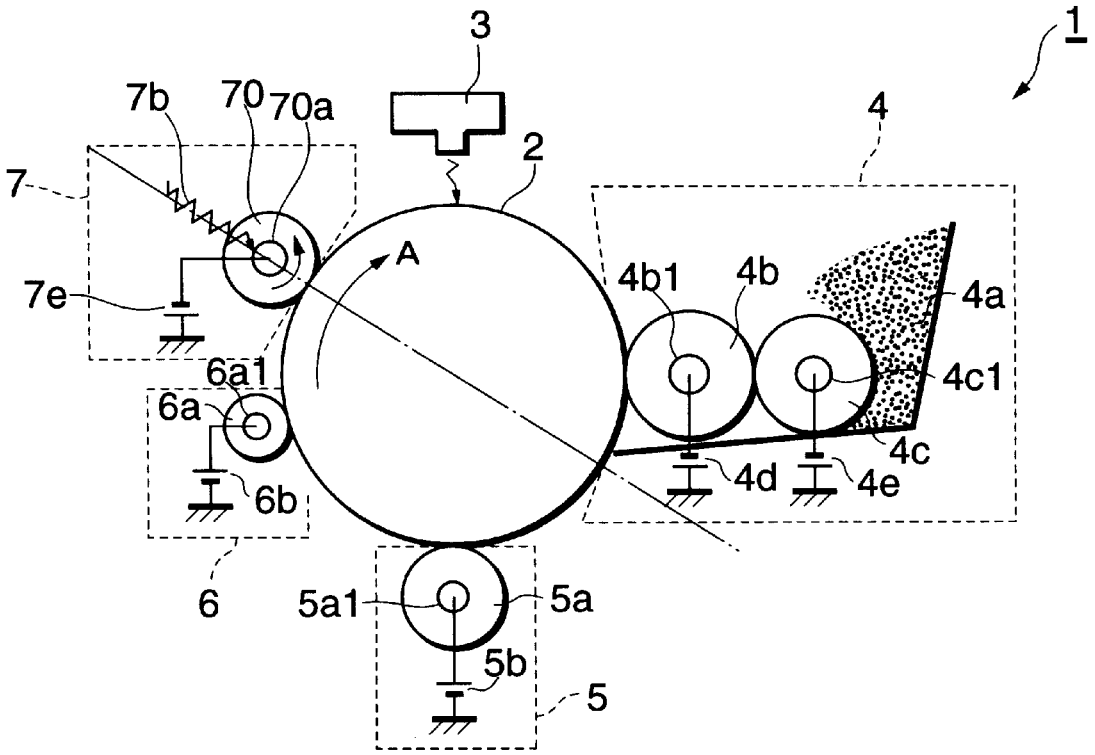
FIG. 1 is a schematic diagram of the electrophotographic recording apparatus according to the present invention.

FIG. 1 is a schematic drawing of a printer according to the present invention.

As shown in FIG. 1, a printer 1 comprises a photosensitive drum 2 capable of rotating in the direction of arrow A; a charging section 7 for giving a substantially uniform electrostatic charge over the external circumferential surface of the photosensitive drum 2; an exposure unit 3 for forming an electrostatic latent image on the photosensitive drum 2 by exposing the charged photosensitive drum 2; a developing section 4 for causing a toner 4*a* to adhere to the electrostatic latent image formed on the photosensitive drum 2; an image transfer section 5 for transferring the toner 4*a* on the electrostatic latent image to a recording medium; and a cleaning section 6 for removing the toner remaining on the photosensitive drum 2 without being transferred to the recording medium.

The recycle system is adopted for the printer 1. According to thus recycle system, as is generally known, the remaining toner recovered from the photosensitive drum 2 by the cleaning section 6 is returned to the photosensitive drum 2 by the cleaning section 6 when printing is not performed, for example, and the toner is carried by the rotating photosensitive drum 2 and collected in the developing section 4.

Figure 2:
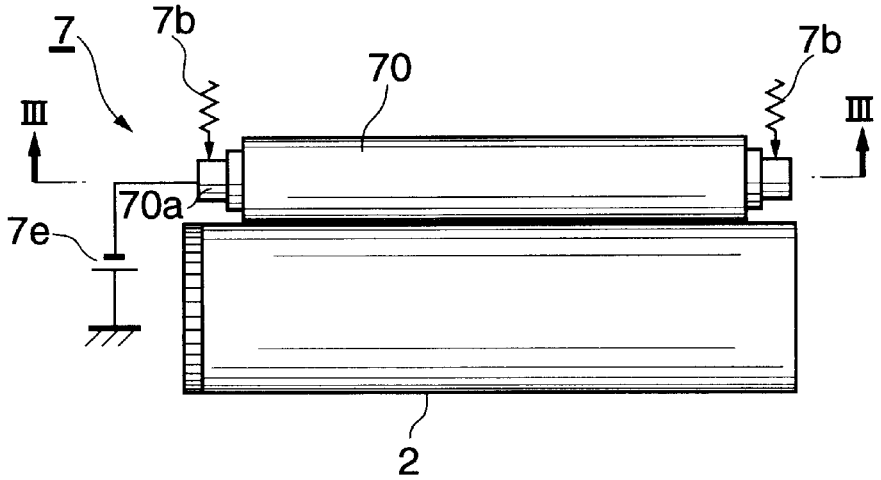
FIG. 2 is a diagram for explaining the photosensitive drum and the charging section of the electrophotographic recording apparatus shown in FIG. 1.

FIG. 2 shows the photosensitive drum 2 and the charging section 7 of the printer 1 shown in FIG. 1.

The charging section 7 includes a charging roller 70 having a rotation shaft 70*a*, which is made of a conductive material and substantially parallel with the rotation shaft of the photosensitive drum 2; springs 7*b* for contacting under pressure the external circumferential surface of the charging roller 70 with the external circumferential surface of the photosensitive drum 2; and a power source 7*e* for applying a DC voltage through the rotation shaft 70*a* to the charging roller 70.

When the power source 7*e* of the charging section 7 applies a negative voltage, for example, to the charging roller 70, as is conventionally well known, the charging roller 70 causes a negative charge to be induced on the external circumferential surface of the photosensitive drum 2, which is in contact with the charging roller 70.

The exposure unit 3 exposes the charged surface of the photosensitive drum 2 according to an image signal. The potential of the exposed portions become nearly zero.

The developing section 4, as is conventionally well known, includes a developing roller 4*b* whose external circumferential surface is in contact with the external circumferential surface of the photosensitive drum 2; and an auxiliary roller 4*c* which is arranged in contact with the external circumferential surface of the developing roller 4*b* in order to cause the toner 4*a* to adhere to the external circumferential surface of the developing roller 4*b*.

In the developing section 4, as is conventionally well known, by applying a negative voltage, for example, to the developing roller 4*b*, the toner 4*a* adhering to the external circumferential surface of the developing roller 4*b* is negatively charged. The negatively charged toner 4*a* adheres to the exposed portions of external circumferential surface of the photosensitive drum 2.

The image transfer section 5 includes a transfer roller 5*a* in contact with the external circumferential surface of the photosensitive drum 2. The image transfer section 5, as is conventionally well known, if a positive voltage, for example, is applied to the transfer roller 5*a,* the negatively charged toner 4*a* on the photosensitive drum 2 is moved to a recording medium that is sent between the photosensitive drum 2 and the transfer roller 5*a*. After the transfer process by movement of the toner 4*a* at the image transfer section 5, as is conventionally well known, the negatively charged toner that did not participate in the transfer process and remains as it is and the positively charged small amount of the toner both keep on adhering to the external circumferential surface of the photosensitive drum 2. The positively charged small amount of the toner is likely to occur between the developing section 4 and the image transfer section 5 as is generally known.

The cleaning section 6 includes a cleaning roller 6*a* whose external circumferential surface is in contact with the external circumferential surface of the photosensitive drum 2. In the cleaning section 6, as has been well known, a positive voltage, for example, is applied to the cleaning roller 6*a*. Therefore, because the cleaning roller is positively charged, the negatively charged toner on the photosensitive drum 2 is attracted to the cleaning roller 6*a*.

On the other hand, the positively charged small amount of the toner on the photosensitive drum 2 is not attracted to the cleaning roller 6*a,* and passes through the cleaning section 6 as the photosensitive drum 2 rotates.

When the positively charged small amount of the toner that has passed the cleaning section 6 enters between the charging roller 70 and the photosensitive drum 2, the positively charged small amount of the toner adheres to the external circumferential surface of the charging roller 70, and the increased resistance value of the charging roller 70 caused by the adhesion of the small quantity of the toner makes it impossible to hold the photosensitive drum 2 at a potential enough for stable printing.

As a countermeasure, in the photosensitive drum 2, as has been well known, the charging roller 70 is rotated faster than the photosensitive drum 2, with the result that the ratio of the circumferential speed of the charging roller 70 to the circumferential speed of the photosensitive drum 2 is greater than 1. Because of this circumferential speed ratio exceeding 1, the above-mentioned small amount of toner is inhibited from entering between the charging roller 70 and the photosensitive drum 2. In the example shown in FIG. 1, the ratio of the circumferential speed of the charging roller 70 to the circumferential speed of the photosensitive drum 2 is set to be 1.4.

Figure 3:
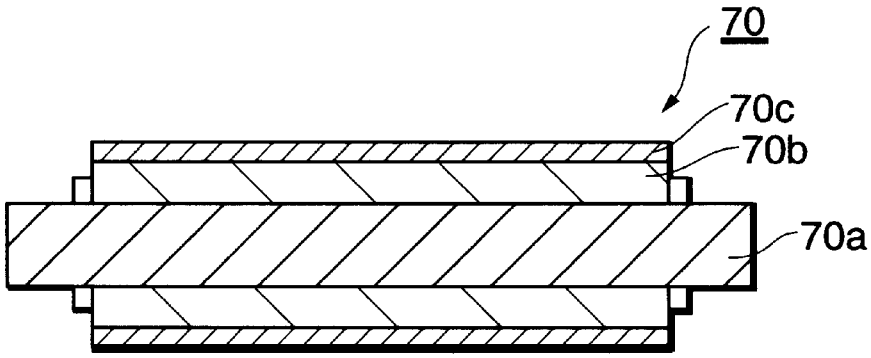
FIG. 3 is a sectional view of the charging roller taken along the line III—III shown in FIG. 2.

FIG. 3 is a sectional view of the charging roller 70 taken along the line III—III shown in FIG. 2.

The charging roller 70 includes a cylindrical member 70*b* enclosing the rotation shaft 70*a* and arranged coaxially with the rotation shaft 70*a*. The cylindrical member 70*b* is made of a semiconductive polyether-urethane rubber with a hardness of 35 (JIS A), for example. Formed around the external circumference of the cylindrical member 70*b* is a surface layer 70*c* containing a polymer of a polyether-urethane resin and a polyamide resin, for example. This polymer shows a relatively high affinity for the above-mentioned polyether-urethane rubber of the cylindrical member 70*b*. In addition, as the hardener for hardening the surface of the surface layer 70*c* to an optional hardness, a melamine resin, for example, is included in the surface layer 70*c*.

Figure 4:
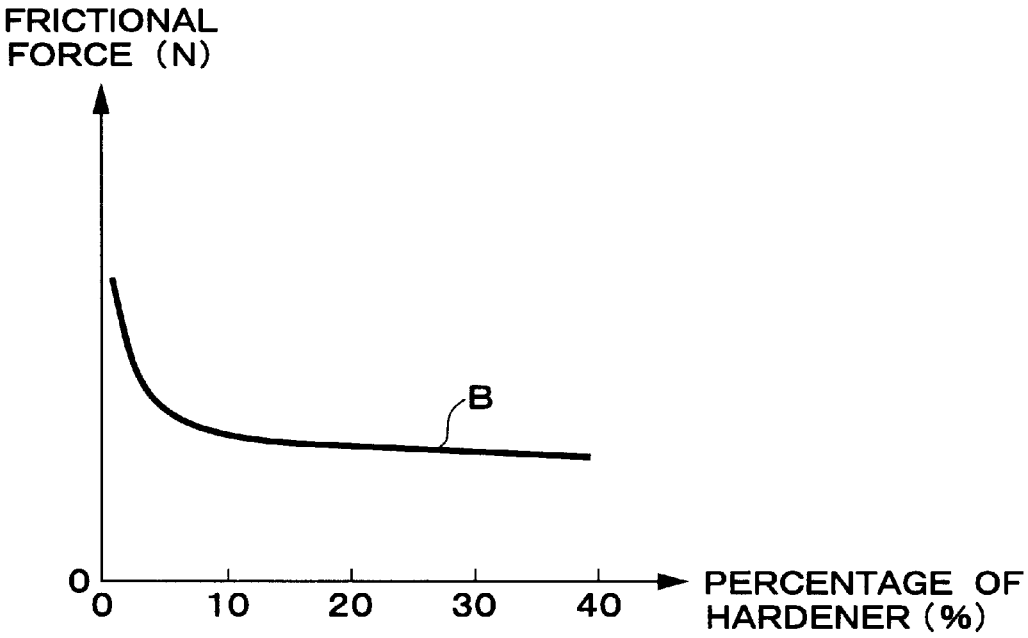
FIG. 4 is a graph showing the relation between the percentage by weight of the hardener included in the surface layer of the charging roller and the magnitude of the frictional force between the charging roller and the photosensitive drum.

FIG. 4 is a graph showing the relation between the percentage by weight of the hardener included in the surface layer of the charging roller and the magnitude of the frictional force between the charging roller and the photosensitive drum.

The abscissa of the graph indicates the percentage (%) by weight of the hardener, and the ordinate indicates the magnitude of the frictional force (N).

In the graph, the characteristic curve B shows changes in the frictional force when the weight percentage of the hardener is varied. As indicated by the characteristic curve B, the frictional force produced between the surface layer 70*c* of the charging roller 70 and the external circumferential surface of the photosensitive drum 2 during printing on the printer 1 decreases as the weight percentage of the hardener included in the surface layer is increased. As is apparent from the characteristic curve B, the frictional force is sufficiently low over the weight percentage of the hardener exceeds 10 percent.

With the charging roller 70 according to the present invention, as mentioned above, because the surface layer 70*c* contains 10 percent or more by weight of the hardener, the frictional force between the surface layer 70*c* and the external circumferential surface of the photosensitive drum 2 is kept to be low, so that triboelectricity generated between the charging roller 70*c* and the photosensitive drum 2 is inhibited by a great measure.

Figure 5:
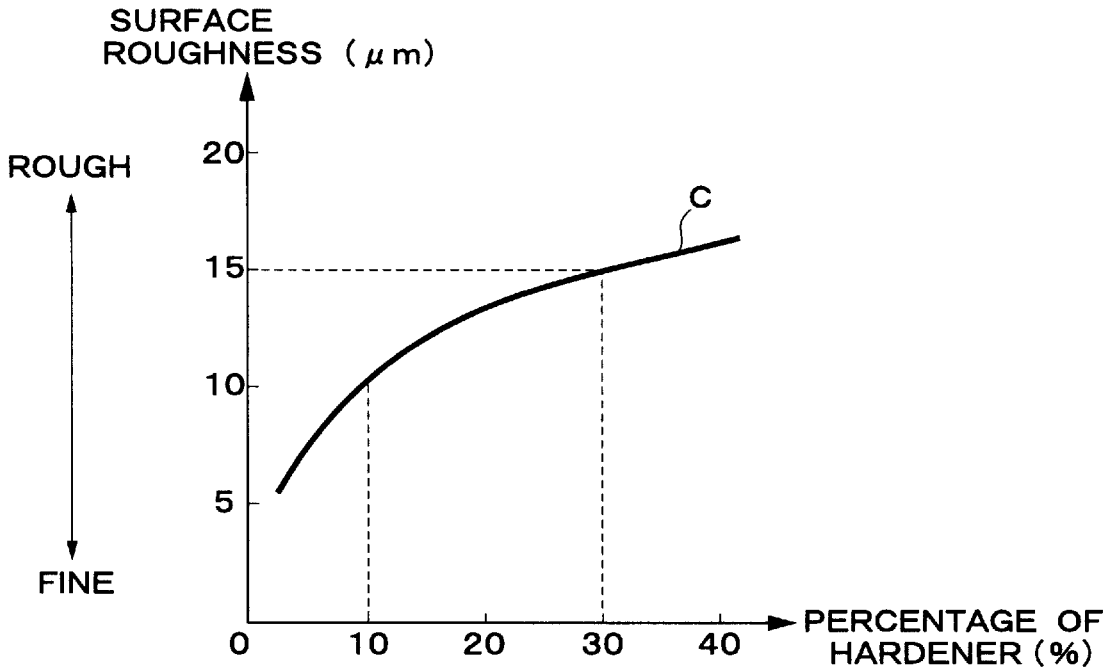
FIG. 5 is a graph showing the relation between the percentage by weight of the hardener included in the surface layer of the charging roller and the surface roughness of the surface layer.

FIG. 5 is a graph showing the relation between the percentage by weight of the hardener included in the surface layer 70*c* of the charging roller 70 and the values of the surface roughness of the surface layer 70*c*.

The abscissa of the graph indicates the percentage (%) by weight of the hardener, and the ordinate indicates the values ($\mu$m) of the above-mentioned surface roughness.

The characteristic curve C in FIG. 5 indicates the changes in the values of the surface roughness of the surface layer 70*c* while the weight percentage of the hardener is varied. As the weight percentage of the hardener included in the surface layer 70*c* increases, the surface hardening of the surface layer 70*c* progresses more rapidly during the forming process of the surface layer 70*c*. Accordingly, the surface of the surface layer 70*c* is formed roughly as the weight percentage of the hardener is increased as shown by the characteristic curve C that rises generally steadily.

Figure 6:
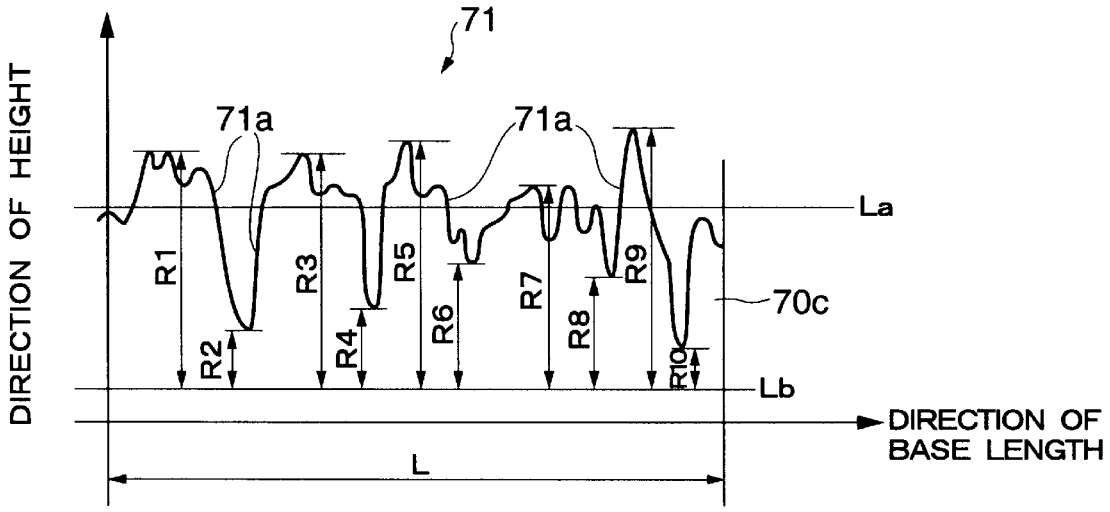
FIG. 6 is a diagram for explaining an arithmetic expression of ten-point-average roughness.

The surface roughness of the surface layer 70*c* is obtained by the arithmetic expression of ten-point-average roughness (JIS B0601) in the example shown in FIG. 6. Cross sectional curve 71 shows the magnified surface fluctuation of the charging roller 70 along the axis thereof.

In the arithmetic expression of ten-point-average roughness, as shown in FIG. 6, within a cross section 71 as wide as the base length L and arbitrarily selected from the surface layer 70*c,* an optional straight line Lb is drawn which is parallel with the direction of the base length L and which does not intersect the surface 71*a*. The heights of the peaks and valleys of the surface 71*a* are measured from the straight line Lb as the reference line. This measurement is made without cutting or grinding the surface 71*a* (without cut-off) under the conditions of the base length L=2.5 mm, the tracer tip radius=2 $\mu$m, the tracer pressure=70 mN and the tracer measuring speed of 0.1 mm/s.

The surface roughness of a given cross section is obtained as follows. An average value of the five heights from the top to the fifth highest (R1, R3, R5, R7 and R9) is obtained. Then, an average value of the five heights from the shortest to the fifth shortest (R2, R4, R6, R8 and R10) is obtained. A difference in units of micrometer ($\mu$m) between the former average value and the latter average value represents the surface roughness of a given cross section, obtained by the above-mentioned arithmetic expression of ten-point average roughness. This ten-point-average roughness is obtained at three different locations of the surface layer 70*c*, and an average of those three ten-point averages is adopted to indicate the surface roughness of the surface layer 70*c* of each weight percentage of the hardener in FIG. 5.

The surface roughness of the surface layer 70*c* of the charging roller 70 is greater for a larger quantity of the hardener included in the surface layer 70*c* as has been described with reference to FIG. 5. As the surface roughness of the surface layer 70*c* increases, a larger amount of toner is likely to adhere to the surface layer 70*c*, so that the resistance value of the charging roller 70 tends to become greater as the result of printing for a long period of time. Before proceeding to detailed description of the relation between the surface roughness of the surface layer 70*c* and the resistance value of the charging roller 70, the method of measuring the resistance of the charging roller 70 is explained in the following.

Figure 7:
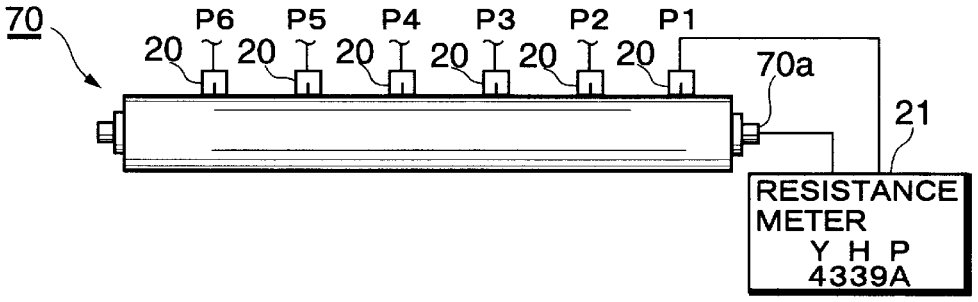
FIG. 7 is a diagram for explaining a method of measuring the resistance value of the charging roller.

FIG. 7 is a diagram for explaining the method for measuring the resistance value of the charging roller 70.

Contacts each having a bearing 20, arranged equally spaced in the axial direction of the charging roller 70 and rotatably contacting the charging roller 70 are pressed against the surface layer 70*c* of the charging roller 70. While the charging roller 70 is rotated, a voltage of 500V is applied across the rotation shaft 70*a* and the respective contacts. Under this condition, the resistance values between the rotation shaft 70*a* and the respective contacts are measured with a resistance meter 21. An average of the measured values is used as the resistance value of the charging roller 70.

Figure 8:
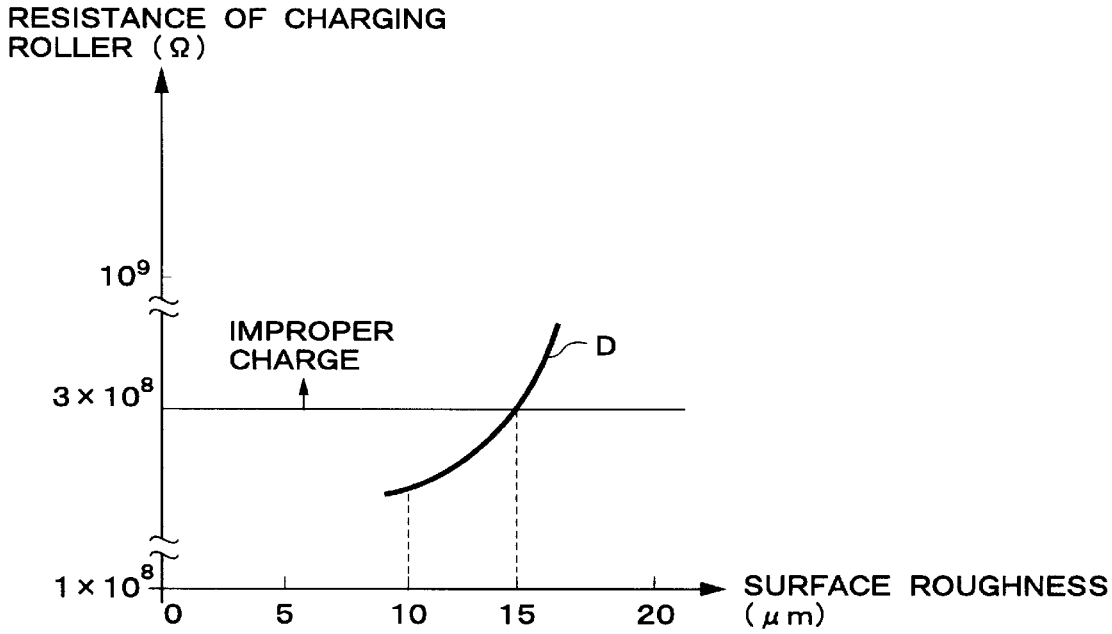
FIG. 8 is a graph showing the relation between the surface roughness and the resistance values of charging rollers measured after 20,000 sheets were printed using the charging rollers with different levels of the surface roughness of the surface layer.

FIG. 8 is a graph showing the relation between the surface roughness and the resistance values of charging rollers, measured after 20,000 sheets were printed using the charging rollers with different levels of the surface roughness of the surface layer at a printing speed of 12 pages per minute.

The abscissa of the graph indicates levels of the surface roughness in $\mu$m of the surface layer 70*c*, and the ordinate indicates the resistance values in ohm of the charging roller 70, measured after printing was finished. The resistance value of the charging roller 70 before printing is $1\times10^8$ [Ω].

In FIG. 8, the characteristic curve D shows changes in the resistance value of the charging roller measured after printing was done with charging rollers with different levels of surface roughness. The resistance value of the charging roller 70 measured after 20,000 sheets were printed becomes greater with the charging roller having greater surface roughness of the surface layer 70*c* as indicated by the characteristic curve D. After the resistance value of the charging roller 70 exceeds about $3\times10^8$ [Ω], it becomes impossible to charge the photosensitive drum 2 to a sufficient potential for stable printing.

For this reason, the surface roughness of the surface layer 70*c* is set to a level that gives rise to a resistance value of $3\times10^8$ [Ω] of the charging roller 70, in other words, the surface roughness is set to 15 $\mu$m or less; corresponding to a resistance value of $3\times10^8$ [Ω]. When the surface roughness is 15 $\mu$m or less, the content of the hardener included in the surface layer 70*c* is not greater than 30 percent by weight as is apparent from the characteristic curve C in FIG. 5 showing the relation between the quantity of the hardener and the surface roughness.

In the charging roller 70 according to the present invention, as described above, because the hardener included in the surface layer 70*c* is 30 percent or less by weight, the toner is inhibited from adhering to the surface layer 70*c*, which is caused by an increase in the surface roughness of the surface layer 70*c* attending on an increase in the hardener content. Therefore, the resistance value of the charging roller 70 is inhibited from increasing due to the toner adhesion to the surface layer 70*c*. Consequently, an insufficient static charge on the photosensitive drum 2 is inhibited from occurring attending on an increase in the resistance value of the charging roller.

Therefore, in the charging roller 70 according to the present invention, as mentioned above, because the surface layer 70*c* contains not less than 10 percent by weight of the hardener, the photosensitive drum 2 is inhibited from being excessively charged by triboelectricity produced between the charging roller 70 and the photosensitive drum 2. Because the hardener included in the surface layer 70*c* is not greater than 30 percent by weight, the photosensitive drum 2 is inhibited from being charged insufficiently due to an increase in the resistance value of the charging roller 70 caused by the adhesion of the toner to the surface layer 70*c*. Consequently, according to the printer 1 incorporating the charging roller 70 according to the present invention, the potential of the photosensitive drum 2 is held in a desired adequate range, so that printing quality can be improved.

In the charging roller according to the present invention, because the content of the hardener included in the surface layer 70*c* is not less than 10 weight percent and not greater than 30 weight percent, the magnitude of the fusion strength to be described later, which is produced between the surface layer 70*c* of the charging roller 70 and the external circumferential surface of the photosensitive drum 2 can be controlled. Before proceeding to description of the function by control of the fusion strength, the method for measuring the fusion strength is explained as follows.

The charging roller 70 is contacted under pressure with the photosensitive drum 2 and they are left to stand for 24 hours at a high temperature of 80° C. and a high humidity of 80 percent, for example. Subsequently, the photosensitive drum 2 is fused with the surface layer 70*c* of the charging roller 70. The charging roller 70 is suspended by a non-elastic string and raised vertically by using a tension gauge. When the photosensitive drum 2 breaks away from the charging roller 70, the value indicated by the tension gauge is read. The value obtained by subtracting the dead weight of the charging roller 70 from the indicated value represents the fusion strength.

Figure 9:
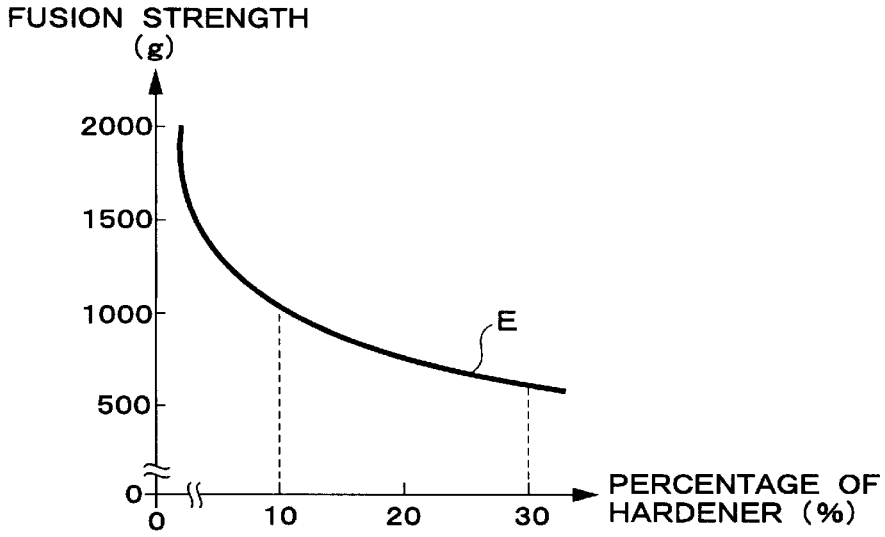
FIG. 9 is a graph showing the relation between the percentage by weight of the hardener included in the surface layer and the magnitude of the fusion bonding force produced between the charging roller and the photosensitive drum.

FIG. 9 is a graph showing the relation between the percentage (%) by weight of the hardener included in the surface layer 70*c* of the charging roller 70 and the fusion strength measured by pulling in the direction as mentioned above.

The abscissa of the graph indicates percentage (%) by weight of the hardener included in the surface layer 70*c*, and the ordinate indicates the magnitude (g) of the fusion strength. The characteristic curve E shows changes in the fusion strength when the proportion of the hardener is varied.

The magnitude of the fusion strength between the surface layer 70*c* of the charging roller 70 and the external circumferential surface of the photosensitive drum 2 depends on the precipitated amount of low-molecular oligomers from the surface layer 70*c*. The more the hardener is included in the surface layer 70*c*, the more the precipitation of the low-molecular oligomers is inhibited. Therefore, the magnitude of the fusion strength decreases as the hardener content in the surface layer 70*c* increases as indicated by the characteristic curve E.

As the magnitude of the fusion strength decreases, the surface layer 70*c* is inhibited from peeling from the cylindrical member 70*b* due to the fusion between the surface layer 70*c* and the photosensitive drum 2. Consequently, the toner is inhibited from adhering to the external surface of the cylindrical member 70*b* due to the peeling of the surface layer 70*c* from the cylindrical member 70*b*, so that the resistance value of the charging roller 70 is inhibited from increasing due to the toner adhesion. Therefore, chances are effectively reduced for the photosensitive drum 2 to be charged insufficiently.

Description will now be made of the method for inquiring into whether or not the potential of the photosensitive drum 2 is held at a value sufficient for stable printing.

Figure 10:
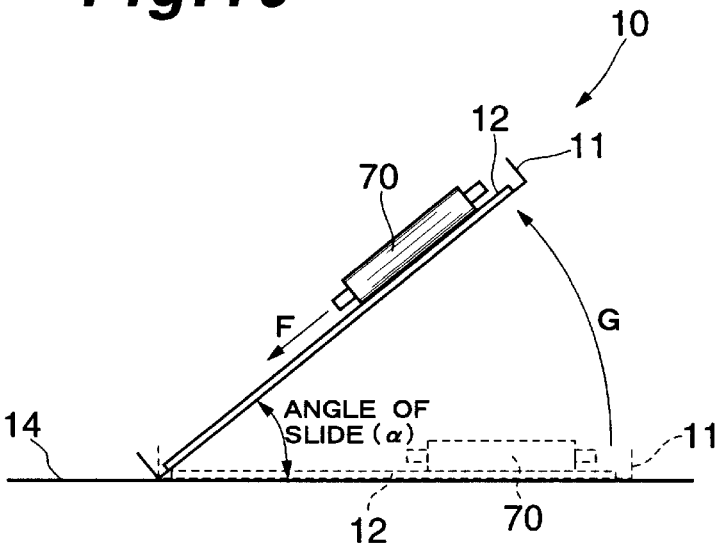
FIG. 10 shows a slide angle measuring device for measuring the angle of slide.

FIG. 10 shows a slide angle-measuring device for measuring the angle of slide to be described later, which corresponds to a frictional force produced between the charging roller 70 and the photosensitive drum 2.

The slide angle measuring device 10 includes a flat plate 11 on which a sheet 12 for OHP (OverHead Projector) panel, for example, formed by a polyester film 100 $\mu$m thick in the example in FIG. 10.

The charging roller 70 is placed on the OHP sheet 12 on the flat plate 11 as indicated by a dotted line. The angle of slide a is an angle at which the charging roller 70 starts to slide in the direction of arrow F coincident with the direction of the rotation shaft 70*a* of the charging roller 70 when the other end of the flat plate 11 is turned upwardly around one end of the flat plate 11 as indicated by the solid line.

In the example of FIG. 10, the angle of slide a of the charging roller 70 according to the present invention is greater than 0° and not more than 20°.

Figure 11:
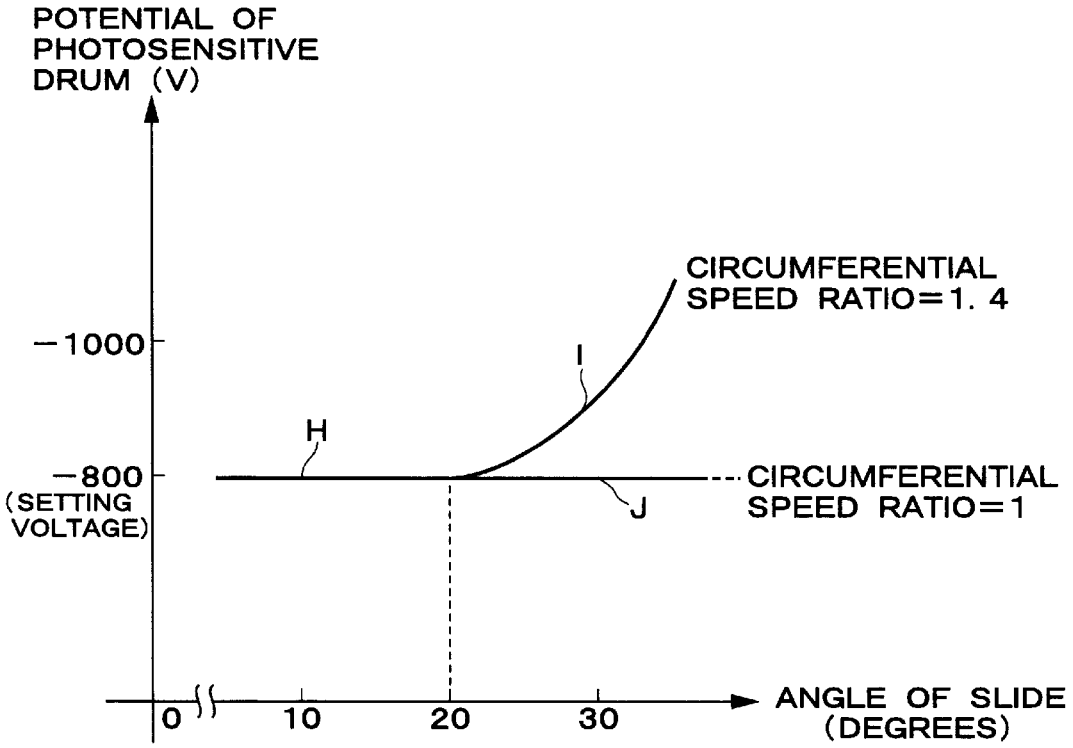
FIG. 11 is a graph showing the relation between the slide angle of the charging roller and the potential of the photosensitive drum.

FIG. 11 is a graph showing the relation between the angle of slide $\alpha$ (°) of the charging roller 70 according to the present invention and the potential of the photosensitive drum 2.

The abscissa of the graph indicates the angles of slide $\alpha$ (°) of the charging roller 70 and the ordinate indicates the potential (V) of the photosensitive drum 2. The characteristic curve H of the graph indicates changes in the potential of the photosensitive drum 2 when the ratio of the circumferential speed of the charging roller 70 to the circumferential speed of the photosensitive drum 2 (hereafter referred to simply as the circumferential speed ratio) is 1.4 and the slide angle a is greater than 0° and not more than 20°. The characteristic curve I in the graph indicates changes in the potential of the photosensitive drum 2 when the circumferential speed ratio is 1.4 and the slide angle $\alpha$ is greater than 20°. The characteristic curve J indicates changes in the potential of the photosensitive drum 2 when the circumferential speed ratio is 1.

In the printer 1 incorporating the charging roller 70 according to the present invention, in other words, the charging roller 70, the slide angle $\alpha$ of which is in a range of greater than 0° and not more than 20°, as indicated by the characteristic curve H, the potential of the photosensitive drum 2 is stably held at a setting voltage of −800V regardless of the slide angle of the charging roller.

In a printer incorporating a charging roller with a slide angle $\alpha$ of greater than 20°, as indicated by the characteristic curve I, the photosensitive drum 2 is charged excessively by triboelectricity produced between the surface layer 70*c* of the charging roller 70 and the external circumferential surface of the photosensitive drum. Therefore, the potential of the photosensitive drum 2 increases by exceeding the setting voltage of −800V and reaches −1000V, for example.

It has been confirmed that in the charging roller according to the present invention with a slide angle a of greater than 0° and not more than 20°, the potential of the photosensitive drum 2 is held at the above-mentioned setting voltage without being excessively charged by triboelectricity produced between the surface layer 70*c* of the charging roller 70 and the external circumferential surface of the photosensitive drum 2 as mentioned above.

In the above-mentioned example, the ratio of the circumferential speed of the charging roller 70 to the circumferential speed of the photosensitive drum 2 was set at 1.4, but the ratio may be set at an optional value larger than 1 and less than 1.4.

In the above-mentioned embodiment, description was made of a case in which the surface layer 70*c* of the charging roller 70 contains a polymer of a polyether-urethane resin and a polyamide resin. However, instead of this polymer, it is possible to use any one of a polymer of a polyester-urethane resin and a polyamide resin, a polyamide resin and a polyimide resin.

Further in the above-mentioned embodiment, description was made of the case in which the surface layer 70*c* contains a melamine resin as the hardener. However, instead of the melamine resin, it is possible to use as the hardener any one of a aniline resin, an alkyd resin, an unsaturated polyester resin, an urea resin, an epoxy resin, a xylene-formaldehyde resin, a ketone-formaldehyde resin, a furan resin, and a phenol resin.

Further in the above-mentioned embodiment, description was made of the case where the cylindrical member 70*b* of the charging roller 70 is formed of a polyether-urethane rubber. However, instead of the polyether-urethane rubber, the cylindrical member 70*b* may be formed of a polyester-urethane rubber.

In the electrophotographic recording apparatus according to the present invention, as mentioned above, because the surface layer of the charging roller contains not less than 10 percent by weight of the hardener, the photosensitive drum is inhibited from being excessively charged by triboelectricity produced between the charging roller and the photosensitive drum. Because the hardener included in the surface layer is not greater than 30 percent by weight, there are less chances that the photosensitive drum is charged insufficiently due to an increase in the resistance value of the charging roller caused by the adhesion of the toner to the surface layer. Consequently, the potential of the photosensitive drum is held in a specified adequate range, so that printing quality can be improved.

What is claimed is:

1. An electrophotographic recording apparatus comprising:

a photosensitive drum having a rotation shaft;

a charging roller for charging said photosensitive drum to a desired potential, said charging roller having a rotation shaft substantially parallel with the rotation shaft of said photosensitive drum and holding an external circumferential surface thereof in contact with said photosensitive drum, a ratio of a circumferential speed of said charging roller to a circumferential speed of said photosensitive drum being greater than 1, wherein said external circumferential surface of said charging roller is defined by a surface layer including a resin and a hardener, and wherein said hardener is included in said surface layer at a proportion of greater than or equal to 10 percent and less than or equal to 30 percent, by weight, of the surface layer.

2. An electrophotographic recording apparatus according to claim 1, wherein said resin is a urethane resin.

3. An electrophotographic recording apparatus according to claim 2, wherein said urethane resin is either one of a polymer of a polyether-urethane resin and a polyamide resin and a polymer of a polyester-urethane resin and a polyamide resin.

4. An electrophotographic recording apparatus according to claim 1, wherein said resin is either one of a polyamide resin and a polyimide resin.

5. An electrophotographic recording apparatus according to claim 1, wherein said hardener is either one of a melamine resin, a aniline resin, an alkyd resin, an unsaturated polyester resin, an urea resin, an epoxy resin, a formaldehyde resin, a furan resin, and a phenol resin.

6. An electrophotographic recording apparatus according to claim 1, wherein the surface roughness of said surface layer is more than 0 $\mu$m and not more than 15 $\mu$m.

7. An electrophotographic recording apparatus according to claim 6, wherein the surface roughness of said surface layer is 10 $\mu$m or more.

8. An electrophotographic recording apparatus according to claim 1, wherein said charging roller includes a generally cylindrical member made of an elastomer disposed coaxially with said rotation shaft of said charging roller, with an outer surface thereof connected with said surface layer and an inner surface thereof connected with said rotation shaft.

9. An electrophotographic recording apparatus according to claim 8, wherein said elastomer is a polyether-urethane rubber or a polyester-urethane rubber.

10. An electrophotographic recording apparatus according to claim 1, wherein the ratio of the circumferential speed of said charging roller to the circumferential speed of said photosenstive drum is equal to or less than 1.4.

11. An electrophotographic recording apparatus comprising:

a photosensitive drum having a rotation shaft:

a charging roller for charging said photosensitive drum to a desired potential, said charging roller having a rotation shaft substantially parallel with the rotation shaft of said photosensitive drum and holding an external circumferential surface thereof in contact with said photosensitive drum, a ratio of a circumferential speed of said charging roller to a circumferential speed of said photosensitive drum being greater than 1, wherein said external circumferential surface of said charging roller is defined by a surface layer including a resin a a hardener, and wherein said hardener is included in said surface layer at a proportion of greater than or equal to 10 percent and less than or equal to 30 percent, by weight of the surface layer, wherein an inclination angle when said charging roller, arranged slidably in the direction of the rotation shaft on a flat plate to be gradually inclined to the horizontal plane, starts to slide is in a specified range.

12. An electrophotographic recording apparatus according to claim 11, wherein a paper for an OverHead Projector panel is arranged on said flat plate, and the inclination angle when said charging roller starts to slide on said paper is greater than 0° and not more than 20°.

* * * * *